US006875726B2

(12) United States Patent
Shuku et al.

(10) Patent No.: US 6,875,726 B2
(45) Date of Patent: Apr. 5, 2005

(54) HEAT-SENSITIVE RECORDING MATERIAL AND PROCESS FOR PRODUCTION OF THE SAME

(75) Inventors: Shigekazu Shuku, Neyagawa (JP); Ayako Saito, Takarazuka (JP)

(73) Assignee: Oji Paper Co., Ltd., Tokyo-to (JP)

( * ) Notice: Subject to any disclaimer, the term of this patent is extended or adjusted under 35 U.S.C. 154(b) by 0 days.

(21) Appl. No.: 10/067,918

(22) Filed: Feb. 8, 2002

(65) Prior Publication Data

US 2002/0155951 A1 Oct. 24, 2002

(30) Foreign Application Priority Data

Feb. 9, 2001 (JP) ..... 2001-033041
Feb. 9, 2001 (JP) ..... 2001-033042

(51) Int. Cl.[7] ..... B41M 5/40
(52) U.S. Cl. ..... 503/226; 156/235; 427/152; 503/200
(58) Field of Search ..... 156/235; 427/152; 503/200, 226

(56) References Cited

FOREIGN PATENT DOCUMENTS

| | | | |
|---|---|---|---|
| JP | 07-032740 | A | 2/1995 |
| JP | 07-125430 | A | 5/1995 |
| JP | 08-011430 | A | 1/1996 |
| JP | 8-90907 | A | 4/1996 |
| JP | 08-090907 | A | 4/1996 |
| JP | 9-24667 | A | 1/1997 |
| JP | 09-024667 | A | 1/1997 |
| JP | 09-234957 | A | 9/1997 |
| JP | 2000-71617 | A | 3/2000 |

*Primary Examiner*—Bruce H. Hess
(74) *Attorney, Agent, or Firm*—Kubovcik & Kubovcik

(57) ABSTRACT

Disclosed are a heat-sensitive recording material which comprises at least (a) a support, (b) a heat-sensitive recording layer formed on at least one side of the support and containing an electron-donating compound and an electron-accepting compound and (c) a protective layer, the protective layer being an outermost layer provided by being formed on a smooth-surfaced substrate and removing the smooth-surfaced substrate, and the protective layer surface having a distinctness of image (according to JIS K 7105-1981) of at least 75% (slit width 2 mm), as well as a process for preparing the heat-sensitive recording material.

22 Claims, No Drawings

HEAT-SENSITIVE RECORDING MATERIAL AND PROCESS FOR PRODUCTION OF THE SAME

BACKGROUND OF THE INVENTION (1) Field of the Invention

The present invention relates to a heat-sensitive recording material utilizing a color-forming reaction between a leuco dye and a developer.

The term "recorded portion" used herein refers to a portion of a heat-sensitive recording material wherein a recorded image has been formed by carrying out recording from the protective layer side of the heat-sensitive recording material with a thermal head.

The term "unrecorded portion" used herein refers to a portion of the heat-sensitive recording material in which no recorded image has been formed by a thermal printer.

(2) Description of Related Art

Recording devices, in which a recording medium used is a heat-sensitive recording material comprising a heat-sensitive recording layer formed on one side of a support such as paper, synthetic paper or plastic film and containing a leuco dye, a developer and a binder, are compact, inexpensive and easy to maintain. Therefore, they are extensively used not only as a recording medium for facsimile machines, ticket-vending machines, scientific measuring instruments and so on but also as an output medium in printers or plotters for POS labels, CAD, CRT medical images or the like.

Among them, for use in image printers in CRT medical measuring instruments which require the uniformity and high resolutions of recorded images and for use in CAD plotters which require the dimensional stability and fine-line recording, synthetic papers of multi-layer structure and biaxially oriented thermoplastic resin films optionally containing an inorganic pigment are used. With an increased diversity of purposes, there is a strong demand for heat-sensitive recording materials having excellent surface gloss and recorded image quality which are comparable with those of silver-salt photographs, and having excellent recording runnability.

Japanese Unexamined Patent Publications Nos.1996-90907 and No.1997-24667 disclose heat-sensitive recording materials having an outermost layer (protective layer) transferred from a smooth surface in order to improve image clarity. However, it is desired to further improve the stability of quality and the distinctness of image of the protective layer surface.

BRIEF SUMMARY OF THE INVENTION

An object of the present invention is to provide a heat-sensitive recording material which is excellent in the quality of recorded image and a process for preparing the same.

The invention provides a heat-sensitive recording material which comprises a support, a heat-sensitive recording layer formed on at least one side of the support and containing at least an electron-donating compound and an electron-accepting compound, and a protective layer, at least the protective layer being formed on a smooth-surfaced substrate and transferred from the smooth-surfaced substrate to one of the other layers of the heat-sensitive recording material, and the protective layer having a distinctness of image of at least 75% according to JIS K 7105-1981 (slit width 2 mm).

Stated more specifically, the invention provides a heat-sensitive recording material which comprises:

(a) a support (S), (b) (b1) a heat-sensitive recording layer (TG) formed on at least one side of the support (S) and containing at least an electron-donating compound and an electron-accepting compound, or (b2) a heat-sensitive recording layer (TG) formed on at least one side of the support (S) and an adhesive layer (EB) formed on the heat-sensitive recording layer (TG), or (b3) an adhesive layer (EB) formed on at least one side of the support (S) and a heat-sensitive recording layer (TG) formed on the adhesive layer; and (c) a protective layer (OC), and if desired, (d) an intermediate layer (ML) formed between the heat-sensitive recording layer (TG) and the protective layer (OC) or between the heat-sensitive recording layer (TG) and the adhesive layer (EB), the protective layer being an outermost layer provided by being formed on a smooth surface of a smooth-surfaced substrate and removing the substrate, and the protective layer surface having a distinctness of image of at least 75% (JIS K 7105-1981, slit width 2 mm).

The heat-sensitive recording material is prepared, for example, by transferring a protective layer formed on a smooth surface of a smooth-surfaced substrate, or by transferring a laminate comprising a protective layer formed on a smooth surface of a smooth-surfaced substrate and at least one layer formed on said protective layer and selected from the group consisting of a heat-sensitive recording layer, an adhesive layer and an intermediate layer, to a laminate comprising a support and at least one layer formed on said support and selected from the group consisting of a heat-sensitive recording layer, an adhesive layer and an intermediate layer, or to a support, and removing the substrate, so as to form the contemplated heat-sensitive recording material.

DETAILED DESCRIPTION OF THE INVENTION

Heat-sensitive Recording Material

As described above, the present invention is characterized in that the heat-sensitive recording material has a protective layer provided by being transferred from a smooth and that the protective layer surface has a distinctness of image of at least 75% according to JIS K 7105-1981 (reflection method; slit width 2 mm).

The distinctness of image is one of the properties of a protective layer surface, and is calculated from the results obtained by measuring the light reflected by the specimen through a moving optical comb by using an apparatus for measuring distinctness of image.

If the distinctness of image is less than 75%, the quality of recorded image is likely to decrease. A more preferred distinctness of image is 80% or higher.

The protective layer surface having a distinctness of image of 75% or more can be produced by various methods. For example, it is produced by forming a protective layer on a smooth-surfaced substrate with a smooth surface which is about 0.05 to about 0.20 $\mu$m in root-mean-square average of roughness (according to JIS B0601-1982) as determined by an interference microscope (according to JIS B0652-1973), and if desired, forming at least one layer selected from the group consisting of a heat-sensitive recording layer, and an adhesive layer and an intermediate layer on the protective layer to form a laminate; and transferring the protective layer or said laminate to a laminate formed on a support and comprising at least one layer selected from the group consisting of a heat-sensitive recording layer, and an adhesive layer and an intermediate layer or to a support, and removing the substrate.

When the smooth surface of the substrate is less than 0.05 μm in root-mean-square average of roughness, the protective layer would be unlikely to separate uniformly from the smooth surface. When the root-mean-square average of roughness of the smooth surface of the substrate is more than 0.20 μm, the distinctness of image and gloss of the protective layer is likely to decrease, resulting in tendency of degrading the quality of recorded image. A preferred range of the surface roughness is from about 0.08 to about 0.20 μm.

A desirable protective layer is one having a distinctness of image of at least 75% as determined by the reflection method defined in JIS K7105-1981 (slit width 2 mm) on the recorded portion formed by carrying out recording from the protective layer side with a high energy of 80 mJ/mm$^2$ by a thermal head with a nip pressure of 15 g/cm.

It is particularly preferable that the root-mean-square average of roughness (according to JIS B0601-1982) of said recorded portion as determined by an interference microscope (according to JIS B0652-1973) is about 0.15 to about 0.50 μm. If the recorded portion is less than 0.15 μm in root-mean-square average of roughness, the recorded portion may be apt to become cracked, whereas the recorded portion which is more than 0.5 μm in root-mean-square average of roughness might fail to give a uniform image quality. The range of approximately 0.20 to 0.40 μm is more preferable. Furthermore, it is preferable that the gloss of the above-mentioned recorded portion (according to JIS P 8142-1993) is 30% or more at 20° and 85% or more at 75°.

When the protective layer is formed of a coating composition predominantly composed of an aqueous resin (=water-soluble resin and/or water-dispersible resin), the heat resistance of the protective layer can be increased by adjusting the water content in the protective layer to 2% or less, or by adding a crosslinking agent to the aqueous resin in an amount of about 1 to about 20% by weight based on the aqueous resin.

It is desirable that the thickness of the protective layer be about 0.5 to about 5.0 μm, preferably about 1.0 to about 3.0 μm.

Examples of the smooth-surfaced substrate are polyethylene (PE) films, polypropylene (PP) films, polystyrene (PS) films, polyethylene terephthalate (PET) films and like resin films, and mirror plated metal drums. Among them, resin films are preferred and their thickness is preferably about 10 to about 50 μm. Particularly preferable are resin films having a root-mean-square average of roughness of 0.05 to 0.20 μm (according to JIS B0601-1982) which are produced, for example, by incorporating a pigment in the resin film or forming an anchor coat layer. Such films are known and commercially available. It is preferable to use a film having a root-mean-square average of roughness of 0.05 to 0.20 μm (according to JIS B0601-1982) selected from among the known films.

Optionally the smooth-surfaced substrate may be subjected to a corona discharge treatment to thereby facilitate the formation of the protective layer.

As described above, the heat-sensitive recording material of the invention comprises a support, a heat-sensitive recording layer and a protective layer, or comprises a support, a heat-sensitive recording layer, an adhesive layer, protective layer and if desired an intermediate layer. Among them, a preferred heat-sensitive recording material comprises a protective layer containing an aqueous resin, an adhesive layer predominantly composed of an adhesive, a heat-sensitive recording layer and a support in this order, or comprises a protective layer containing an aqueous resin, a heat-sensitive recording layer, an adhesive layer predominantly composed of an adhesive and a support in this order. More preferable is the heat-sensitive recording material of the above structure having an intermediate layer containing an aqueous resin between the heat-sensitive recording layer and the protective layer or between the heat-sensitive recording layer and the adhesive layer.

Particularly, the following heat-sensitive recording materials are preferred:

(1) a heat-sensitive recording material comprising:
- a support,
- a heat-sensitive recording layer formed on the support,
- an intermediate layer formed on the heat-sensitive recording layer,
- an adhesive layer preferably comprising an electron beam-cured resin, and
- a protective layer formed on the adhesive layer and comprising an aqueous resin, (2) a heat-sensitive recording material comprising:
- a support,
- an adhesive layer (preferably comprising an electron beam cured resin) formed on the support,
- a heat-sensitive recording layer formed on the adhesive layer, and
- a protective layer formed on the heat-sensitive recording layer and comprising an aqueous resin;

(3) a heat-sensitive recording material comprising:
- a support,
- an adhesive layer (preferably comprising an electron beam cured resin) formed on the support,
- an intermediate layer formed on the adhesive layer,
- a heat-sensitive recording layer formed on the intermediate layer, and
- a protective layer formed on the heat-sensitive recording layer and comprising an aqueous resin;

(4) a heat-sensitive recording material comprising:
- a support,
- a heat-sensitive recording layer formed on the support,
- an intermediate layer formed on the heat-sensitive recording, and
- a protective layer formed on the intermediate layer comprising an electron beam-cured resin.

When the protective layer is contacted with the adhesive layer (especially an adhesive layer comprising an electron beam-cured resin), the surface of the protective layer to be contacted with the adhesive layer preferably has an Oken smoothness according to J. TAPPI No. 5-B of at least 8000 seconds, particularly 9000 to 12000 seconds and a root-mean-square average of roughness according to JIS B0601-1982 of 0.45 μm or less, particularly 0.25 to 0.45 μm.

When the intermediate layer is contacted with the adhesive layer (especially an adhesive layer comprising an electron beam-cured resin), the surface of the intermediate layer to be contacted with the adhesive layer preferably has an Oken smoothness according to J. TAPPI No. 5-B of 4000 to 9000 seconds.

When the support is contacted with the adhesive layer (especially an adhesive layer comprising an electron beam-cured resin), the support surface to be contacted with the adhesive layer preferably has an Oken smoothness according to J. TAPPI No. 5-B of at least 200 seconds, particularly about 400 to about 1000 seconds, and a root-mean-square average of roughness according to JIS B0601-1982 of 2.0 μm or less, particularly 0.2 to 1.0 μm.

When the surface of the heat-sensitive recording layer is contacted with the adhesive layer, the heat-sensitive recording layer surface preferably has an Oken smoothness according to J. TAPPI No. 5-B of at least 1000 seconds, particularly about 3000 to about 7000 seconds, and a root-mean-square average of roughness according to JIS B0601-1982of 0.65 μm or less, particularly 0.40 to 0.65 μm.

The Oken smoothness and the root-mean-square average of roughness of the respective layers can be adjusted to the above ranges, for example, by carrying out a super-calender treatment after the layers are formed, or by using the solid components (such as a pigment which may be contained in the adhesive layer) which have been pulverized to an average particle size within a certain range, or by adjusting the coating amount of the coating composition for forming the respective layers, or like methods.

Process for Producing a Heat-sensitive Recording Material of the Present Invention The heat-sensitive recording material according to the present invention which comprises at least (a) a support, (b) a heat-sensitive recording layer formed on at least one side of the support and containing an electron-donating compound and an electron-accepting compound and (c) a protective layer, wherein the protective layer surface has a distinctness of image (according to JIS K 7105-1981) of at least 75% (slit width 2 mm), can be prepared by various methods.

Basically, the heat-sensitive recording material of the invention which comprises:

(a) the support (S), (b) (b1) the heat-sensitive recording layer (TG) formed on at least one side of the support, or (b2) the heat-sensitive recording layer (TG) formed on at least one side of the support and an adhesive layer (EB) formed on the heat-sensitive recording layer, or (b3) an adhesive layer formed (EE,) on at least one side of the support and the heat-sensitive recording layer (TG) formed on the adhesive layer; and (c) the protective layer (OC), and if desired, (d) an intermediate layer (ML) formed between the heat-sensitive recording layer (TG) and the protective layer (OC) or between the heat-sensitive recording layer (TG) and the adhesive layer (EB), wherein the protective layer surface has a distinctness of image (according to JIS K 7105-1981) of at least 75% (slit width 2 mm), is prepared by a process characterized in that the protective layer is provided by being formed on a smooth-surfaced substrate with a smooth surface which is about 0.05 to about 0.20 μm in the root-mean-square average of roughness (according to JIS B0601-1982) as determined by an interference microscope (according to JIS B0652-1973), and removing the smooth-surfaced substrate.

Specifically, the heat-sensitive recording material is preferably produced by one of the following methods.

(I) A process comprising transferring a protective layer formed on a smooth-surfaced substrate to a laminate comprising a support, a heat-sensitive recording layer, an intermediate layer and an adhesive layer in this order, in such a manner that the protective layer is brought into contact with the adhesive layer.

(II) A process comprising transferring a protective layer formed on a smooth-surfaced substrate and an adhesive layer (preferably comprising an electron beam-cured resin) formed on the protective layer, or transferring a protective layer (preferably comprising an electron beam-cured resin) formed on a smooth-surfaced substrate to a laminate comprising a support, a heat-sensitive recording layer and an intermediate layer in this order, in such a manner that the adhesive layer or the protective layer (preferably comprising an electron beam-cured resin) is brought into contact with the intermediate layer.

(III) A process comprising transferring a protective layer formed on a smooth-surfaced substrate and a heat-sensitive recording layer formed on the protective layer and an intermediate layer formed on the heat-sensitive recording layer to a laminate comprising a support and an adhesive layer (preferably comprising an electron beam-cured resin) in this order, in such a manner that the intermediate layer is brought into contact with the adhesive layer.

(IV) A process comprising transferring a laminate formed on a smooth-surfaced substrate and comprising a protective layer, a heat-sensitive recording layer and an adhesive layer in this order, or transferring a laminate formed on a smooth-surfaced substrate and comprising a protective layer, a heat-sensitive recording layer, an intermediate layer and an adhesive layer (preferably comprising an electron beam-cured resin) in this order, to a support in such a manner that the adhesive layer is brought into contact with the support.

(V) A process comprising transferring a laminate comprising a protective layer (preferably comprising an electron beam-cured resin) an intermediate layer, a heat-sensitive recording layer and a support in this order to a smooth-surfaced substrate, in such a manner that the protective layer is brought into contact with the smooth-surfaced substrate.

More preferably, the heat-sensitive recording material of the present invention is prepared by any one of the following methods.

(i) A process comprising combining a protective layer (OC) formed on a smooth-surfaced substrate and comprising a water-soluble or water-dispersible resin with a laminate comprising a support (S), a heat-sensitive recording layer (TG), an intermediate layer (ML) and an uncured adhesive layer (EB) comprising an electron beam-curable compound in this order, in such a manner that the protective layer (OC) is brought into contact with the uncured adhesive layer (EB), irradiating the combined product with electron beam to cure the electron beam-curable compound, and removing the smooth-surfaced substrate.

(ii) A process comprising combining a protective layer (OC) formed on a smooth-surfaced substrate and an uncured adhesive layer (EB) comprising an electron beam-curable compound and formed on the protective layer, or combining an uncured protective layer (OC(EB)) comprising an electron beam-curable compound and formed on a smooth-surfaced substrate, with a laminate comprising a support (S), a heat-sensitive recording layer (TG) and an intermediate layer (ML) in this order, in such a manner that the adhesive layer (EB) or the protective layer (OC(EB)) comprising an electron beam-curable compound is brought into contact with the intermediate layer (ML), irradiating the combined product with electron beam to cure the electron beam-curable compound, and removing the smooth-surfaced substrate.

(iii) A process comprising combining a protective layer (OC) comprising a water-soluble resin or water-dispersible resin and formed on a smooth-surfaced substrate, a heat-sensitive recording layer (TG) formed on the protective layer and an intermediate layer (ML) formed on the heat-sensitive recording layer with a laminate comprising a support (S) and an uncured adhesive layer (EB) comprising an electron beam-curable compound in this order, in such a manner that the intermediate layer (ML) is brought into contact with the uncured adhesive layer (EB), irradiating the combined product with electron beam to cure the electron beam-curable compound, and removing the smooth-surfaced substrate.

(iv) A process comprising combining a laminate formed on a smooth-surfaced substrate and comprising a protective layer (OC) comprising a water-soluble or water-dispersible resin, a heat-sensitive recording layer (TG), an intermediate layer (ML) and an uncured adhesive layer (EB) comprising an electron beam-curable compound in this order, with a support (S) in such a manner that the uncured adhesive layer (EB) is brought into contact with the support (S), irradiating the combined product with electron beam to cure the electron beam-curable compound, and removing the smooth-surfaced substrate.

(v) A process comprising combining a laminate comprising an uncured protective layer (OC(EB)) comprising an electron beam-curable compound, an intermediate layer (ML), a heat-sensitive recording layer (TG) and a support (S) in this order with a smooth-surfaced substrate, in such a manner that the uncured protective layer (OC(EB)) is brought into contact with the smooth-surfaced substrate, irradiating the combined product with electron beam to cure the electron beam-curable compound, and removing the smooth-surfaced substrate.

Among the above processes (i) to (v), process (i) is preferred.

The heat-sensitive recording material of the present invention may be prepared by a process comprising the steps of superimposing, on one side of a smooth-surfaced resin film, a protective layer, a heat-sensitive recording layer, an intermediate layer and an uncured adhesive layer predominantly composed of an electron beam-curable compound in this order; bringing the uncured adhesive layer (more specifically the uncured adhesive layer predominantly composed of an electron beam-curable compound) into contact with one side of a support; irradiating the combined product with electron beam and peeling the smooth-surfaced resin film alone from the protective layer surface.

The heat-sensitive recording material of the present invention may also be prepared by a process comprising the steps of superimposing, on one surface of a smooth-surfaced resin film, a protective layer and an uncured adhesive layer predominantly composed of an electron beam-curable compound in this order; superimposing a heat-sensitive recording layer and an intermediate layer on a support; bringing the intermediate layer into contact with the uncured adhesive layer; and peeling the resin film of smooth surface alone from the protective layer surface after electron-beam irradiation.

In addition, the heat-sensitive recording material of the present invention may be prepared by a process comprising the steps of superimposing a protective layer (comprising a water-soluble or water-dispersible resin) on one side of a smooth-surfaced resin film; forming a heat-sensitive recording layer, an intermediate layer and an uncured adhesive layer predominantly composed of an electron beam-curable compound in this order on one side of a support; bringing the protective layer into contact with the uncured adhesive layer; irradiating the combined product with electron beam and peeling the smooth-surfaced resin film alone from the protective layer surface.

<Protective Layer>

The protective layer is formed, for example, as follows. A protective layer coating composition is prepared by mixing an aqueous resin and optionally auxiliaries to be described below with stirring using water as a medium. The obtained coating composition is applied to a smooth-surfaced substrate in an amount of about 0.5 to about 5 g/m$^2$, preferably about 1 to about 3 g/m$^2$, on dry basis, and the coating is dried to form a protective layer.

Examples of aqueous resins to be incorporated into the protective layer include water-soluble resins and water-dispersible resins, such as starch, hydroxyethyl cellulose, methyl cellulose, carboxymethyl cellulose, gelatin, casein, gum abrabic, completely saponified polyvinyl alcohol, partially saponified polyvinyl alcohol, silicon-modified polyvinyl alcohol, acetoacetyl-modified polyvinyl alcohol, carboxyl-modified polyvinyl alcohol, diisobutylene-maleic anhydride copolymer salts, styrene-maleic anhydride copolymer salts, ethylene-acrylic acid copolymer salts, styrene-butadiene-based latex, acrylic latex, urethane-based latex, etc. The preferable amount of the aqueous resin to be used is about 30 to about 95% by weight, particularly about 35 to about 70% by weight, based on the weight of the solids of the protective layer.

Among the above aqueous resins, more preferable are completely saponified polyvinyl alcohol, partially saponified polyvinyl alcohol, silicon-modified polyvinyl alcohol, acetoacetyl-modified polyvinyl alcohol, carboxyl-modified polyvinyl alcohol, etc.

Useful auxiliaries are, for example, sodium dioctylsulfosuccinate, sodium dodecylbenzene sulfonate, sodium lauryl sulfate and like surfactants, zinc stearate, calcium stearate, carnauba wax, paraffin wax, ester wax, stearyl phosphate and like lubricants, kaolin, clay, talc, aluminum hydroxide, calcined clay, titanium oxide, diatomaceous earth, amorphous silica and like pigments, glyoxal, polyamideamine-epichlorohydrin, melamine resins, boric acid, borax and like crosslinking agents, coloring dyes, fluorescent dyes and so on. The amount of these auxiliaries to be used can be selected from a wide range. Generally, however, it is preferable that the amount of these auxiliaries be in the range of about 0.01 to about 70 wt. %, particularly about 0.05 to about 60 wt. %, based on the protective layer.

Among the above auxiliaries, preferable are pigments, such as kaolin and aluminum hydroxide, having an average particle size of 0.01 to 1.8 $\mu$m.

Alternatively, the protective layer may be formed using an electron beam-curable compound. In this case, an protective layer coating composition predominantly containing an electron beam-curable compound is applied in an amount of about 0.5 to about 5 g/m$^2$, preferably about 1 to about 3 g/m$^2$, and the uncured protective layer is contacted with other layer (e.g. an intermediate layer). Thereafter the electron beam-curable compound is cured by irradiation with electron beam to form a protective layer. The protective layer coating composition may further contain a pigment, if so desired.

In this embodiment, since said protective layer adheres to other layer (such as an intermediate layer) upon irradiation with electron beam, the protective layer to be formed from the electron beam-curable compound also act as an adhesive layer. Therefore, the details of the electron beam-curable compound, pigment, preparation method of the coating composition, electron beam irradiation and the like which will be described with respect to the adhesive layer in the item <adhesive layer> below are all applicable to the protective layer formed using an electron beam-curable compound.

<Adhesive Layer>

The adhesive layer can be formed by applying an adhesive layer coating composition predominantly comprising a tackifier such as acrylic resin, synthetic rubber, natural rubber or the like in an aqueous or organic solvent in an amount of about 0.5 to about 5 g/m$^2$, preferably about 1 to about 3 g/m$^2$, on dry basis, and drying the coating film.

Alternatively, an adhesive layer coating composition predominantly containing an electron beam-curable compound is applied in an amount of about 0.5 to about 5 g/m$^2$, preferably about 1 to about 3 g/m$^2$, and the coating of the uncured adhesive layer is contacted with other layer (e.g. a surface of protective layer) formed on a smooth surface. Thereafter the electron beam-curable compound is cured by irradiation with electron beam to form an adhesive layer. The adhesive layer coating composition predominantly containing an electron beam-curable compound more uniformly adheres to other layer, and is preferable.

When required, an adhesive layer may contain a pigment, whereby recorded image quality is advantageously improved. The average particle size of the pigments including secondary particles is preferably about 0.2 to about 3.0 $\mu$m. If the average particle size is less than 0.2 $\mu$m, the effect of improving the recorded image quality is insufficient. The use of pigments having an average particle size of more than 3.0 $\mu$m is likely to degrade the transferability to other layer and deteriorate the recorded image quality. The range of about 0.5 to about 2.5 $\mu$m is more preferred. Herein, the average particle size is measured by an electron microscope observation.

The pigment to be incorporated into the adhesive layer may have a form of e.g., spheres, needles, plates or pillars or may be in an amorphous form. Specific examples of such pigments are kaolin, clay, talc, calcium carbonate, aluminum hydroxide, calcined clay, titanium oxide, diatomaceous earth, silica, barium sulfate, acrylic resin fillers, benzoguanamine-formaldehyde polycondensate fillers, melamine-formaldehyde polycondensate fillers, etc. Among them, benzoguanamine-formaldehyde polycondensate fillers, melamine-formaldehyde polycondensate fillers and calcium carbonate are preferred. The amount of the pigment in the adhesive layer is preferably about 2 to about 30% by weight, more preferably about 3 to about 20% by weight, based on the adhesive layer.

Examples of the electron beam-curable compound to be incorporated in the adhesive layer coating composition include, for example, monomers and prepolymers having at least one ethylenically unsaturated bond. Examples of such monomers are:

monofunctional monomers such as N-vinylpyrrolidone, acrylonitrile, styrene, methyl (meth)acrylate, ethyl (meth)acrylate, acrylamide, benzyl acrylate, 2-ethylhexyl acrylate, 2-hydroxyethyl (meth)acrylate, 2-hydroxy-3-phenoxyproxyl acrylate, tetrahydrofurfuryl acrylate. phenoxyethyl acrylate, nonylphenoxyethyl acrylate, acrylate adducted caprolactone, butoxyethyl (meth)acrylate, cyclohexyl (meth)acrylate, N,N-dimethylaminomethyl (meth)acrylate, N,N-dimethylaminoethyl (meth)acrylate, 3-phenoxypropyl acrylate, 2-methoxyethyl (meth)acrylate and like (meth)acrylates;

polyfunctional monomers such as hexanecliol diacrylate, neopentyl glycol diacrylate, diethylene glycol diacrylate, tripropylene glycol diacrylate, tetraethylene glycol diacrylate, tricyclodecane-dimethylol diacrylate, trimethylolpropane triacrylate, dipentaerythritol hexaacrylate, dipentaerythritol pentaacrylate, acrylate of ε-caprolactone-modified dipentaerythritol, diacrylate of ethylene oxide-modified bisphenol A and the like;

(meth)acrylic acid condensate of epichlorohydrin-alkanediol polymer such as (meth)acrylic acid condensate of epichlorohydrin-hexanediol polymer, etc.

Examples of the prepolymer include prepolymers formed from these monomers. At least two of these monomers or at least two of the prepolymers may be used in mixture.

The above electron beam-curable compound (said monomers and/or prepolymers) is usually used in an amount of about 75 to 98 wt. %, preferably about 80 to 95 wt. %, based on the adhesive layer.

Among the above-exemplified electron beam-curable compounds, those having one or more (particularly 1 to 3) hydroxyl group are preferable to use. Thereby, when the adhesive layer is contacted with the protective layer predominantly containing an aqueous resin and the intermediate layer, the protective layer is uniformly transferred.

Examples of the hydroxyl group-containing electron beam-curable compounds are 2-hydroxyethyl (meth) acrylate, 2-hydroxypropyl (meth)acrylate, 2-hydroxy-3-phenoxypropyl acrylate, (meth)acrylic acid condensate of epichlorohydrin-alkanediol polymer, etc.

In the specification and claims, the term "(meth)acrylate" means methacrylate or acrylate and the term "(meth)acrylic acid" means methacrylic acid or acrylic acid.

In the present invention, it is more preferable to use such hydroxyl-containing electron beam-curable compound in process (i) described in the item "Process for producing a heat-sensitive recording material of the present invention" above.

The adhesive layer coating composition containing the electron-beam-curable compound can be prepared by dispersing, e.g., a composition comprising an electron-beam-curable compound and if desired a pigment using a three-roll mill, sand mill, paint conditioner, an ultrasonic disperser or the like.

Electron-beam accelerators for use in electron beam irradiation are not limited and include, for example, electro-curtain type, scanning type and like electron beam irradiators. Among them, electro-curtain type which are inexpensive and capable of obtaining high output can be effectively used. Electron beam is applied at an accelerating voltage of about 30 to about 300 KV.

<Support>

Useful supports include synthetic paper prepared by kneading a polyolefin resin and a white inorganic pigment with heating, extruding the melt from a die, stretching the extrudate in the lengthwise direction, laminating one or two layers of a film formed from a polyolefin resin and a white inorganic pigment on both sides of the lengthwise stretched film, and stretching the obtained laminated film in the widthwise (transverse) direction to make the film translucent or opaque.

Further examples include a film formed by heating and kneading polyethylene, polypropylene, polystyrene, polyester or like thermoplastic resin either alone or in combination, extruding the melt from a die and biaxially stretching the extrudate; an biaxially stretched opaque film formed from a mixture of the above-exemplified resin and a white inorganic pigment; and paper made of pulp fibers such as wood-free paper, mechanical paper, acid-free paper, recycled paper, coated paper and the like. The support to be used weigh about 20 to about 250 g/m$^2$.

<Heat-sensitive Recording Layer>

The heat-sensitive recording layer containing an electron-donating compound and an electron-accepting compound may use, e.g., a combination of a leuco dye and a developer, a combination of a diazonium salt and a coupler, a combination of a chelate compound and iron, cobalt, copper or like transition elements, a combination of an imino compound and an aromatic isocyanate compound, etc. The combination of a leuco dye and a developer is excellent in color density and therefore preferred. Now detailed description is given below on the heat-sensitive recording layer comprising a combination of a leuco dye serving as an electron-donating compound and a developer serving as an electron-accepting compound.

Leuco dyes useful for incorporation into the heat-sensitive recording layer are not particularly limited and include, for example, various known-leuco dyes. Specific examples of such leuco dyes are 3,3-bis(p-dimethylaminophenyl)-6-dimethylaminophthalide, 3-diethylamino-7-anilinofluoran, 3-cyclohexylamino-6-chlorofluoran, 3-diethylamino-6-methyl-7-chlorofluoran, 3-diethylamino-7-chlorofluoran, rhodamine (o-chloroanilino)lactam, 3-diethylamino-6,8-dimethylfluoran, 3-(N-ethyl-N-isoamyl)amino-6-methyl-7-anilinofluoran, 3-(N-methyl-N-cyclohexyl)amino-6-methyl-7-anilinofluoran, 3-diethylamino-6-methyl-7-anilinofluoran, 3-di(n-butyl)amino-6-methyl-7-anilinofluoran, 3-di(n-pentyl)amino-6-methyl-7-anilinofluoran, 3-diethylamino-7-(o-chloroanilino)fluoran, 3-di(n-butyl)amino-7-(o-floroanilino)fluoran, 3-(N-ethyl-p-toluidino)-6-methyl-7-anilinofluoran, 3-(N-ethyl-N-tetrahydrofurfurylamino)-6-methyl-7-anilinofluoran, 3,3-bis[1-(4-methoxyphenyl)-1-(4-dimethylaminophenyl)ethylene-2-yl]-4,5,6,7-tetrachlorophthalide, 3-p-(p-dimethylaminoanilino)anilino-6-methyl-7-chlorofluoran, 3-p-(p-chloroanilino)anilino-6-methyl-7-chlorofluoran, 3,6-bis(dimethylamino)fluoren-9-spiro-3'-(6'-dimethylamino)phthalide, etc.

Examples of the developer are 4,4'-isopropylidenediphenol, 1,1-bis(4-hydroxyphenyl) cyclohexane, benzyl 4-hydroxybenzoate, 4,4'-dihydroxydiphenylsulfone, 2,4'-dihydroxydiphenylsulfone, 4-hydroxy-4'-isopropoxdiphenylsulfone, bis(3-ally-4-hydroxyphenyl)sulfone, 4-hydroxy-4'-methyldiphenylsulfone, 4-hydroxyphenyl-4'-benzyloxyphenylsulfone, 3,4-dihydroxyphenyl-4'-methylphenylsulfone, 2,4-bis(phenylsulfone)phenol and like phenolic compounds; N,N'-di-m-chlorophenylthiourea and like thiourea compounds; N-p-tolylsulfonyl-N'-3-(p-tolylsulfonyloxy)phenylurea, p-tolylsulfonyl-p-aminophenol, N-(p-tolylsulfonyl)-N'-(p-tolyl)urea and the like which have one or more —$SO_2NH$— bonds in the molecule; zinc p-chlorobenzoate, zinc 4-[2-(p-methoxyphenoxy)ethyloxy]salicylate, zinc 4-[3-(p-tolylsulfonyl)propyloxyl]salicylate, zinc 5-[p-(2-p-methoxyphenoxyethoxy)cumyl]salicylate and like aromatic carboxylic acid zinc salts, etc.

The proportions of the leuco dye and the developer in the heat-sensitive recording layer are not particularly limited and can be suitably selected depending on the kinds of the leuco dye and the developer to be used. The developer is used in an amount of about 1 to about 10 parts by weight, preferably about 1 to about 5 parts by weight, per part by weight of the leuco dye. The leuco dye is used in an amount of about 5 to about 40% by weight, preferably about 10 to about 35% by weight, based on the weight of the solids of the heat-sensitive recording layer.

If desired, the heat-sensitive recording layer may contain a sensitizer, a print stability-improving agent and the like, as exemplified below.

Examples of useful sensitizers are stearic acid amide, behenic acid amide, dibenzyl terephthalate, dibenzyl oxalate, di(p-methylbenzyl) oxalate, di(p-chlorobenzyl) oxalate, dibutyl isophalate, 2-naphthyl benzyl ether, 1,2-di (3-methylphenoxy)ethane, 1,2-diphenoxyethane, 1-phenoxy-2-(β-naphthoxy)ethane, diphenyl carbonate, p-benzylbiphenyl, etc.

Examples of the print stability-improving agent are 2,2'-methylenebis(4-methyl-6-tert-butylphenol), 4,4'butylidene-bis(6-tert-butyl-m-cresol), 1,1,3-tris(2-methyl-4-hydroxy-5-tert-butylphenyl)butane, 1,1,3-tris(2-methyl-4-hydroxy-5-cyclohexylphenyl)butane, 2,2'-methylenebis(4-ethyl-6-tert-butylphenol), 4,4'-thiobis(2-methyl-6-tert-butylphenol) and like hindered phenols; 2-(2'-hydroxy-5'-methylphenyl) benzotriazole, 2-hydroxy-4-octyloxybenzophenone and like UV absorbers, etc.

Each of the sensitizer and the print stability-improving agent, if employed, is used in an amount of about 0.1 to about 4 parts by weight, preferably about 0.5 to about 3 parts by weight, per part by weight of the leuco dye.

The heat-sensitive recording layer can be prepared, for example, by pulverizing a leuco dye, a developer, and if desired a sensitizer, a print stability-improving agent and the like in water serving as a dispersion medium, either jointly or separately, to an average particle size of 2 $\mu$m or less using a sand mill, attritor, a ball mill or like pulverizers; adding a binder and if desired one or more auxiliaries given below to give a heat-sensitive recording layer coating composition; applying the coating composition to a support (or other layer) in an amount of about 3 to about 20 g/$m^2$, preferably about 3 to about 10 g/$m^2$, on dry basis; and drying the coating.

The binder to be incorporated in the heat-sensitive layer coating composition includes, for example, the aqueous resin to be contained in the protective layer coating composition. The amount of the adhesive to be used is about 8 to about 35% by weight, preferably about 10 to about 30% by weight, based on the weight of the solids of the heat-sensitive recording layer. Useful auxiliaries include, for example, auxiliaries to be present in the protective layer coating composition.

<Intermediate Layer>

An intermediate layer containing an aqueous resin may be formed, if necessary, to prevent background fogging of the heat-sensitive recording layer and to improve the print stability of the recorded portion.

The aqueous resin to be contained in the intermediate layer can be suitably selected from aqueous resins to be incorporated in the protective layer. Among them, it is preferred to use completely saponified polyvinyl alcohol, partially saponified polyvinyl alcohol, silicon-modified polyvinyl alcohol, acetoacetyl-modified polyvinyl alcohol, carboxyl-modified polyvinyl alcohol and casein.

The intermediate layer is preferably formed by applying a coating composition containing the aqueous resin dissolved or dispersed therein in an amount of about 1 to about 5 g/$m^2$ on dry basis, and drying the coating film. The coating composition may contain at least one of the auxiliaries which can be incorporated in the protective layer coating composition, when so required.

Each of the coating compositions for respective layers can be applied by a curtain coater, gravure coater, blade coater, lip coater, bar coater or like conventional coaters.

In order to increase the recording sensitivity and quality of recorded image, it is possible to form an undercoat layer between the support and the heat-sensitive recording layer, the undercoat layer predominantly containing an oil-absorbing pigment or organic hollow particles. It is also possible to form a protective layer, a tackifier layer and a magnetic recording layer on the rear side of the support. Other conventional techniques available in the manufacture of heat-sensitive recording materials can be employed when so required.

EXAMPLES

The present invention will be described below in more detail with reference to the following examples to which, however, the invention is not limited. The parts and percentages used in the examples are all by weight unless otherwise specified.

Example 1

Preparation of Dispersion A

A composition comprising 20 parts of 3-di(n-butyl) amino-6-methyl-7-anilinofluoran, 5 parts of a 10% aqueous solution of polyvinyl alcohol and 20 parts of water was pulverized to an average particle size of 1.3 μm with a sand mill.

Preparation of Dispersion B

A composition comprising 50 parts of 4-hydroxy-4'-isopropoxydiphenylsulfone, 5 parts of a 10% aqueous solution of polyvinyl alcohol and 70 parts of water was pulverized to an average particle size of 1.3 μm with a sand mill.

Preparation of Heat-sensitive Recording Layer Coating Composition

A heat-sensitive recording layer coating composition was prepared by mixing and stirring a composition comprising 30 parts of Dispersion A, 90 parts of Dispersion B, 52 parts of a 60% slurry of calcium carbonate, 40 parts of a 10% aqueous solution of polyvinyl alcohol, 28 parts of styrene-butadiene-based latex (trade name: L-1537, solid conc. 50%, product of Asahi Chemical Industry Co., Ltd.), 11 parts of stearic acid amide (trade name: Hymicron G-270, solid conc. 20%, product of Chukyo Yushi Kabushiki Kaisha), 13 parts of zinc stearate (trade name; Hidrin Z-7-30, solid conc. 30%, product of Chukyo Yushi Kabushiki Kaisha) and 82 parts of water.

Preparation of Intermediate Layer Coating Composition

An intermediate layer coating composition was prepared by mixing and stirring a composition comprising 70 parts of a 60% slurry of kaolin (trade name; UW-90, product of Engelhard Corp.), 180 parts of a 10% aqueous solution of silicon-modified polyvinyl alcohol (trade name; R-1130, product of Kuraray Co., Ltd.) and 150 parts of water.

Preparation of Adhesive Layer Coating Composition

An adhesive layer coating composition was prepared by dispersing, by a three-roll mill, 80 parts of ε-caprolactone-modified dipentaerythritol acrylate (trade name; KAYARAD DPCA-60, product of NIPPON KAYAKU CO., LTD.), 20 parts of acrylic acid mono-condensate of epichlorohydrin-hexanediol polymer and 10 parts of melamine-formaldehyde polycondensation product (=filler; trade name; Epostar S12, product of NIPPON SHOKUBAI CO., LTD.) having an average particle size of 1.2 μm.

Preparation of Protective Layer Coating Composition

A protective layer coating composition was prepared by mixing and stirring a composition comprising parts of an acrylic latex (trade name; Bariastar B-1000 solid conc. 20%, product of Mitsui Chemicals, Inc.), 60 parts of a 10% aqueous solution of silicon-modified polyvinyl alcohol, 75 parts of a 60% slurry of kaolin (trade name; UW-90, product of Engelhard Corp.) with an average particle size of 0.8 μm, 10 parts of potassium stearyl phosphate (trade name; Upol 1800, solid conc. 35%, product of Matsumoto Yushi Seiyaku Kabushiki Kaisha), 5 parts of a 25% aqueous solution of polyamideamine-epichlorohydrin, 10 parts of a 5% aqueous solution of sodium dioctylsulfosuccinate and 100 parts of water.

Preparation of Heat-sensitive Recording Material

The heat-sensitive recording layer coating composition was applied to one surface of synthetic paper (trade name; YUPO FPG-80, product of YUPO Corporation) serving as a support in an amount of 8.0 g/m$^2$ on dry basis by a bar coating method, and was dried to form a heat-sensitive recording layer. An intermediate layer was formed by applying the intermediate layer coating composition to the heat-sensitive recording layer in an amount of 3.0 g/m$^2$ on dry basis by a bar coating method, and drying the coating film. Thereafter the intermediate layer was subjected to super-calender treatment. An adhesive layer was formed by applying the adhesive layer coating composition to the intermediate layer in an amount of 3.0 g/m$^2$ to form an uncured adhesive layer.

Aside from the above, a smooth-surfaced PET film (having an anchor coat layer) which was 0.11 μm in root-mean-square average of roughness and 40 μm in thickness serving as a smooth-surfaced substrate was subjected to corona discharge treatment immediately before application of the protective layer coating composition. Then, the protective layer coating composition was applied to the anchor coat layer of the PET film in an amount of 1.0 g/m$^2$ on dry basis by a bar coating method, and the coating was dried, followed by super-calender treatment. Subsequently the uncured adhesive layer was brought into contact with the protective layer, and the combined product was passed through a roller comprising a metal roll and an elastic roll for closely contacting the uncured adhesive layer with the protective layer.

Thereafter the adhesive layer was cured by irradiation with electron beam from the PET film side at an absorbed dose of 4.0 Mrads and an accelerating voltage of 175 KV with an electro-curtain type electron beam-accelerator (product of Energy Sciences, Inc.). Then, the PET film was peeled off from the protective layer, whereby a heat-sensitive recording material was obtained.

Example 2

A heat-sensitive recording material was prepared in the same manner as in Example 1 with the exception of using 10 parts of 2-hydroxyethyl methacrylate and 10 parts of 2-hydroxypropyl methacrylate in place of 20 parts of acrylic acid mono-condensate of epichlorohydrin-hexanediol polymer in the preparation of the adhesive layer coating composition in Example 1.

Example 3

A heat-sensitive recording material was prepared in the same manner as in Example 1 with the exception of using 20 parts of 2-hydroxy-3-phenoxypropyl acrylate in place of 20 parts of acrylic acid mono-condensate of epichlorohydrin-hexanediol polymer in the preparation of the adhesive layer coating composition in Example 1.

Example 4

A heat-sensitive recording material was prepared in the same manner as in Example 1 with the exception of using 10 parts of calcium carbonate having an average particle size of 1.5 μm in place of 10 parts of melamine-formaldehyde polycondensation product having an average particle size of 1.2 μm in the preparation of the adhesive layer coating composition in Example 1.

Example 5

A heat-sensitive recording material was prepared in the same manner as in Example 1 with the exception of using 10 parts of benzoguanamine-formaldehyde polycondensation product having an average particle size of 2.0 μm in place of 10 parts of melamine-formaldehyde polycondensation product having an average particle size of 1.2 μm in the preparation of the adhesive layer coating composition in Example 1.

Example 6

A heat-sensitive recording material was prepared in the same manner as in Example 1 with the exception of using 20 parts of acrylate of ε-caprolactone-modified dipentaerythritol (trade name: KAYARAD DPCA-60, product of NIPPON KAYAKU CO., LTD.) and 10 parts of spherical silica having an average particle size of 1.5 μm in place of 20 parts of acrylic acid mono-condensate of epichlorohydrin-hexanediol polymer and 10 parts of malamine-formaldehyde polycondensation product having an average particle size of 1.2 μm in the preparation of the adhesive layer coating composition in Example 1.

Example 7

A heat-sensitive recording material was prepared in the same manner as in Example 6 with the exception of preparing the heat-sensitive recording material of Example 6 as follows.

Preparation of Heat-sensitive Recording Material

The heat-sensitive recording layer coating composition was applied to one surface of synthetic paper (trade name; Yupo FPG-80, product of YUPO) Corporation) in an amount of 8.0 g/m$^2$ on dry basis by a bar coating method and dried to form a heat-sensitive recording layer, and the intermediate layer coating composition was applied to the heat-sensitive recording layer in an amount of 3.0 g/m$^2$ on dry basis by a bar coating method and dried to form an intermediate layer, followed by a super-calender treatment.

Aside from the above, the protective layer coating composition was applied to an anchor coat layer of a smooth-surfaced PET film (0.11 μm in root-mean-square average of roughness and 40 μm in thickness) serving as a smooth-surfaced substrate in an amount of 1.0 g/m$^2$ on dry basis by a bar coating method, and was dried, followed by super-calender treatment. The PET film was subjected to corona discharge treatment immediately before application of the protective layer coating composition. Then, the adhesive layer coating composition was applied to the protective layer in an amount of 3.0 g/m$^2$ to form an uncured adhesive layer.

Then the uncured adhesive layer was brought into contact with the intermediate layer, and the combined product was passed through a roller comprising a metal roll and an elastic roll for closely contacting the uncured adhesive layer with the intermediate layer. Thereafter the adhesive layer was cured by irradiation with electron beam from the PET film side at an accelerating voltage of 175 KV and at an absorbed dose of 4.0 Mrads with an electro-curtain type electron beam-accelerator (product of ENERGY SCIENCES, INC. Co., Ltd.). Then, the PET film was peeled off from the protective layer, whereby a heat-sensitive recording material was obtained.

Example 8

A heat-sensitive recording material was prepared in the same manner as in Example 6 with the exception of preparing a heat-sensitive recording material as described below in preparing the heat-sensitive recording material of Example 6.

Preparation of Heat-sensitive Recording Material

To a PET film (incorporating a pigment) which was 20 μm in thickness and 0.08 μm in root-mean-square average of roughness and which had been subjected to a corona discharge treatment immediately before application of the protective layer coating composition were sequentially applied by a bar coating method (each followed by drying) the protective layer coating composition, the heat-sensitive recording layer coating composition and the intermediate layer coating composition in amounts of 3.0 g/m$^2$, 8.0 g/m$^2$ and 3.0 g/m$^2$, respectively, on dry basis to give a dried laminate. Then, the obtained laminate was subjected to super-calender treatment.

Aside from the above, an adhesive layer coating composition was applied to one surface of synthetic paper (trade name; Yupo FPG-80, product of YUPO Corporation.) in an amount of 3.0 g/m$^2$ to form an uncured adhesive layer.

Then the uncured adhesive layer was brought into contact with the intermediate layer, and the combined product was passed through a roller comprising a metal roll and an elastic roll for closely contacting the uncured adhesive layer with the intermediate layer. Thereafter the adhesive layer was cured by irradiation with electron beam from the PET film side at an accelerating voltage of 175 KV and an absorbed dose of 4.0 Mrads with an electro-curtain type electron beam-accelerator (ENERGY SCIENCES, INC.). Then, the PET film was peeled off from the protective layer, whereby a heat-sensitive recording material was obtained.

Example 9

A heat-sensitive recording material was prepared in the same manner as in Example 6 with the exception of preparing a heat-sensitive recording material as described below in preparing the heat-sensitive recording material of Example 6.

Preparation of Heat-sensitive Recording Material

To an anchor coat layer of a PET film which was 40 μm in thickness and 0.11 μm in root-mean-square average of roughness and which had been subjected to a corona discharge treatment immediately before application of the protective layer coating composition were sequentially applied by a bar coating method (each followed by drying), the protective layer coating composition and the heat-sensitive recording layer coating composition in amounts of 3.0 g/m$^2$ and 8 g/m$^2$, respectively, on dry basis to give a dried laminate. The obtained laminate was subjected to super-calender treatment. Further, the adhesive layer coating composition was applied to the heat-sensitive recording layer in an amount of 3.0 g/m$^2$ to form an uncured adhesive layer.

Then the uncured adhesive layer was brought into contacted with synthetic paper (trade name; Yupo FPG-80, product of YUPO Corporation), and the combined product was passed through a roller comprising a metal roll and an elastic roll for closely contacting the uncured adhesive layer with the synthetic paper. Thereafter the adhesive layer was cured by irradiation with electron beam from the PET film side at an accelerating voltage of 175 KV and absorbed dose of 4.0 Mrads with an electro-curtain type electron beam-accelerator (ENERGY SCIENCES, INC.). Then, the PET film was peeled off from the protective layer, whereby a heat-sensitive recording material was obtained.

Example 10

A heat-sensitive recording material was prepared in the same manner as in Example 6 with the exception of using a protective layer coating composition to be described below in place of the protective layer coating composition used in Example 6 and preparing a heat-sensitive recording material as described below in preparing the heat-sensitive recording material of Example 6.

Preparation of Protective Layer Coating Composition

A protective layer coating composition was prepared by dispersing, by a three-roll mill, a composition comprising 100 parts of acrylate of ε-caprolactone-modified dipentaerythritol (trade name; KAYARAD DPCA-60, product of NIPPON KAYAKU CO., LTD.) serving as the electron beam-curable compound, and 10 parts of kaolin having an average particle size of 0.8 μm.

Preparation of Heat-sensitive Recording Material

To one surface of synthetic paper (trade name; Yupo FPG-80, product of YUPO Corporation), the heat-sensitive recording layer coating composition and the intermediate layer coating composition were sequentially applied by a bar coating method (each followed by drying) in amounts of 8.0 $g/m^2$ and 3.0 $g/m^2$, respectively, on dry basis in this order to form a heat-sensitive recording layer and an intermediate layer. The obtained laminate was subjected to super-calender treatment. Then, the protective layer coating composition was applied to the intermediate layer in an amount of 2.0 $g/m^2$ to form an uncured protective layer.

Then, the uncured protective layer was brought into contacted with an anchor coat layer of a smooth-surfaced PET film which was 0.11 μm in root-mean-square average of roughness and 40 μm in thickness and which had been subjected to corona discharge treatment immediately before contact with the uncured protective layer. The combined product was passed through a roller comprising a metal roll and an elastic roll for closely contacting the uncured protective layer with the PET film. The protective layer was cured by irradiation with electron beam from the PET film side at an accelerating voltage of 175 KV and an absorbed dose of 4.0 Mrads with an electro-curtain type electron beam-accelerator (ENERGY SCIENCES, INC.). Then, the PET film was peeled off from the protective layer, whereby a heat-sensitive recording material was obtained.

Example 11

A heat-sensitive recording material was prepared in the same manner as in Example 10 with the exception of preparing a heat-sensitive recording material as described below in preparing the heat-sensitive recording material of Example 10.

Preparation of Heat-sensitive Recording Material

To one surface of synthetic paper (trade name; Yupo FPG-80, product of YUPO Corporation.), the heat-sensitive recording layer coating composition and the intermediate layer coating composition were sequentially applied in this order by a bar coating method (each followed by drying) in amounts of 8.0 $g/m^2$ and 3.0 $g/m^2$, respectively, on dry basis and dried to form a heat-sensitive recording layer and an intermediate layer. The obtained laminate was subjected to super-calender treatment.

Separately, to an anchor coat layer of a PET film which was 0.11 μm in root-mean-squares average of roughness and 40 μm in thickness and which had been subjected to a corona discharge treatment immediately before application of the protective layer coating composition, the protective layer coating composition was applied in an amount of 2.0 $g/m^2$ to form an uncured protective layer.

The intermediate layer on the support side was brought into contact with the uncured protective layer, and the combined product was passed through a roller comprising a metal roll and an elastic roll for closely contacting the uncured protective layer with the intermediate layer. Then, the protective layer was cured by irradiation with electron beam from the side of the PET film at an accelerating voltage of 175 KV and absorbed dose of 4.0 Mrads with an electro-curtain type electron beam-accelerator (ENERGY SCIENCES, INC.). Then, the PET film was peeled off from the protective layer, whereby a heat-sensitive recording material was obtained.

Example 12

A heat-sensitive recording material was prepared in the same manner as in Example 1 with the exception of not using the melamine-formaldehyde polycondensation product (=filler; trade name; Epostar S12, product of Nippon Shokubai Co., Ltd.) having an average particle size of 1.2 μm in preparing the adhesive layer coating composition in Example 1.

Example 13

A heat-sensitive recording material was prepared in the same manner as in Example 6 with the exception of using a PET film which was 100 μm in thickness and 0.18 μm in root-mean-square average of roughness instead of the PET film which was 40 μm in thickness and 0.11 μm in root-mean-square average of roughness.

Example 14

A heat-sensitive recording material was prepared in the same manner as in Example 6 with the exception of preparing the heat-sensitive recording material of Example 6 as described below.

Preparation of Heat-sensitive Recording Material

To an anchor coat layer of a PET film which was 40 μm in thickness and 0.11 μm in root-mean-square average of roughness and which had been subjected to corona discharge treatment immediately before application of the protective layer coating composition, the protective layer coating composition, the heat-sensitive recording layer coating composition and the intermediate layer coating composition were sequentially applied in this order by a bar coating method (each followed by drying) in amounts of 1.0 $g/m^2$, 3.0 $g/m^2$ and 8.0 $g/m^2$, respectively, on dry basis. The obtained laminate was super-calendered. Then, the adhesive layer coating composition was applied to the intermediate layer in an amount of 3.0 $g/m^2$ to form an uncured adhesive layer.

The uncured adhesive layer was brought into contact with one surface of synthetic paper (trade name; Yupo FPG-80, product of YUPO Corporation.), and the combined product was passed through a roller comprising a metal roll and an elastic roll for closely contacting the uncured adhesive layer with the synthetic paper. Thereafter the adhesive layer was cured by irradiation with electron beam from the PET film side at an accelerating voltage of 175 KV and an absorbed dose of 4.0 Mrads with an electro-curtain type electron beam-accelerator (ENERGY SCIENCES, INC.). Then, the PET film was peeled off from the protective layer, whereby a heat-sensitive recording material was obtained.

Example 15

A heat-sensitive recording material was prepared in the same manner as in Example 6 with the exception of using the following adhesive layer coating composition in place of the adhesive layer coating composition used in Example 6.

Preparation of Adhesive Layer Coating Composition

An adhesive layer coating composition was prepared by dispersing, with a three roll mill, 80 parts of acrylate of ε-caprolactone-modified dipentaerythritol (trade name; KAYARAD DPCA-60, product of NIPPON KAYAKU CO., LTD.), 20 parts of acrylic acid mono-condensate of epichlorohydrin-hexanediol polymer and calcium carbonate having an average particle size of 1.5 μm.

Comparative Example 1

A heat-sensitive recording material was prepared in the same manner as in Example 1 with the exception of using a PET film which was 40 μm in thickness and 0.24 μm in root-mean-square average of roughness instead of the PET film which was 40 μm in thickness and 0.11 μm in root-mean-square average of roughness in preparing the heat-sensitive recording material in Example 1.

Comparative Example 2

A heat-sensitive recording material was prepared in the same manner as in Example 1 with the exception of using a PET film which was 40 μm in thickness and 0.02 μm in root-mean-square average of roughness which had no anchor coat layer instead of the PET film which was 40 μm in thickness and 0.11 μm in root-mean-square average of roughness in preparing the heat-sensitive recording material of Example 1.

Comparative Example 3

A heat-sensitive recording material was prepared in the same manner as in Example 1 with the exception of using 50 parts of a 60% slurry of kaolin (trade name; UW-90, product of Engelhard Corp.) and 30 parts of a 50% slurry of calcium carbonate with an average particle size of 2.1 μm instead of 75 parts of a 60% slurry of kaolin (trade name; UW-90, product of Engelhard Corp.) in preparing the protective layer of Example 1.

Comparative Example 4

A heat-sensitive recording material was prepared in the same manner as in Example 3 with the exception of using the protective layer coating composition used in Comparative Example 3 instead of the protective layer coating composition used in Example 3.

The heat-sensitive recording materials thus prepared were tested for the following properties and the results are shown in Table 1.

[Distinctness of Image]

Using an image clarity meter (trade name; ICM-1DP, product of SUGA TEST INSTRUMENTS CO., LTD.) with a slit width of 2 mm, the distinctness of image was evaluated by the reflection method according to JIS K 7105-1981 in respect of an unrecorded portion and a recorded portion formed by carrying out recording by a thermal head (resistance value 520Ω, 8 dots/mm, 0.015 $mm^2$/dot, applied pulse width 2 milliseconds, applied pulse cycle 5 milliseconds, nip pressure 15 g/cm) at an energy of 80 $mJ/mm^2$ (high energy).

[Smoothness]

The surface smoothness (Oken smoothness) was measured by a smoothness tester (Digital Oken Smoothness Tester, Product of Asahi Seiko Co., Ltd.)

[Root-bean-square Average of Roughness]

The root-mean-square average of roughness (JIS B0601-1982) was measured by an interference microscope (trade name; ZYGO, X200, rms calculation-type, product of Canon, Inc.) which satisfied the requirements of JIS B0652-1973.

[Crack]

The presence or absence of crack, in the recorded portion was visually inspected with a magnifying glass, the recorded portion being recorded by a thermal head (resistance value 520Ω, 8 dot/mm, 0.015 $mm^2$/dot, applied pulse width 2 milliseconds, applied pulse cycle 5 milliseconds) with an energy of 80 $mJ/mm^2$ (high energy).

[Gloss]

The gloss (according to JIS P8142-1993) of an unrecorded portion and the recorded portion was measured using a gloss meter (trade name; GM-26D, product of Murakami Color Research Laboratory) at an incidence angle of 20 degrees and 75 degrees, the recorded portion being formed by carrying out recording with a thermal head (resistance value 520Ω, 8 dot/mm, 0.015 $mm^2$/dot, applied pulse width 2 milliseconds, applied pulse cycle 5 milliseconds) with an energy of 30 $mJ/mm^2$ (low energy) or 80 $mJ/mm^2$ (high energy).

[Quality of Recorded Image]

Half-tone printing was carried out on a heat-sensitive recording material according to the pattern internally provided in a printer (trade name; UP-880, product of Sony Corp.), and the image quality of recorded portion was visually evaluated. The visual evaluation was made based on the following scale of 1–6. The higher the value of recorded image quality in Table 1 is, the better the recorded image quality is.

6: White spots are not found at all in the recorded portion and the image quality is very uniform.

5: White spots are rarely found in the recorded portion but the image quality is very uniform 4: White spots are rarely found in the :recorded portion but the image quality is uniform.

3: White spots are slightly found in the recorded portion but the image quality is uniform.

2: White spots are slightly found in the recorded portion and the image quality is less uniform.

1: Lots of white spots are found in the recorded portion and the image quality is not uniform.

The results of the above evaluation are shown in Table 1.

In column "Root-mean-square average of roughness" of Table 1, items "Unrecorded portion" and "Recorded portion" show the values of root-mean-square average of roughness measured with respect to the unrecorded portion and recorded portion of the protective layer (outermost layer) of the heat-sensitive recording material. Item "Smooth-surfaced substrate surface" shows the values of root-mean-square average of roughness of the smooth surface of the PET film used.

In column "Root-mean-square average of roughness" and "Smoothness" of Table 1, items "Adhesive layer-contacted protective layer side ←" show the values of the root-mean-square average of surface roughness and Oken smoothness of the layer present on the protective layer side (such as protective layer, intermediate layer or heat-sensitive recording layer) to be contacted with the adhesive layer measured before being contacted with the adhesive layer. Items "Adhesive layer-contacted support side →" shows the values of the root-mean-square average of roughness and Oken smoothness of the layer present on the support side (such as intermediate layer or heat-sensitive recording layer or support) to be contacted with the adhesive layer measured before being contacted with the adhesive layer.

TABLE 1

| | Gloss | | | Distinctness of image (%) | | Root-mean-square average of roughness (μm) | | |
|---|---|---|---|---|---|---|---|---|
| | Unrecorded portion 20°/75° | Low-energy recorded portion 20°/75° | High-energy recorded portion 20°/75° | Unrecorded portion | Recorded portion | Unrecorded portion | Recorded portion | Smooth-surfaced substrate surface |
| Example 1 | 44/96 | 47/96 | 43/96 | 96 | 90 | 0.18 | 0.24 | 0.11 |
| Example 2 | 45/96 | 48/96 | 43/92 | 98 | 91 | 0.18 | 0.24 | 0.11 |
| Example 3 | 45/96 | 47/96 | 43/93 | 98 | 91 | 0.18 | 0.24 | 0.11 |
| Example 4 | 44/96 | 47/96 | 43/93 | 97 | 89 | 0.20 | 0.26 | 0.11 |
| Example 5 | 44/96 | 47/96 | 43/93 | 95 | 89 | 0.31 | 0.34 | 0.11 |
| Example 6 | 40/94 | 43/94 | 39/91 | 87 | 81 | 0.29 | 0.33 | 0.11 |
| Example 7 | 40/94 | 43/94 | 39/91 | 87 | 81 | 0.30 | 0.33 | 0.11 |
| Example 8 | 42/95 | 44/96 | 40/93 | 87 | 82 | 0.26 | 0.29 | 0.08 |
| Example 9 | 42/95 | 44/96 | 40/94 | 86 | 79 | 0.27 | 0.30 | 0.11 |
| Example 10 | 43/97 | 45/97 | 41/92 | 98 | 76 | 0.16 | 0.24 | 0.11 |
| Example 11 | 43/97 | 45/97 | 41/92 | 98 | 76 | 0.17 | 0.25 | 0.11 |
| Example 12 | 35/93 | 37/93 | 33/90 | 84 | 78 | 0.31 | 0.35 | 0.11 |
| Example 13 | 34/88 | 37/89 | 31/86 | 84 | 77 | 0.41 | 0.43 | 0.18 |
| Example 14 | 43/96 | 46/96 | 41/95 | 90 | 83 | 0.26 | 0.29 | 0.11 |
| Example 15 | 36/92 | 37/92 | 32/90 | 82 | 75 | 0.36 | 0.40 | 0.14 |
| Comp.Ex. 1 | 24/90 | 26/90 | 23/86 | 67 | 62 | 0.54 | 0.57 | 0.24 |
| Comp.Ex. 2 | 26/89 | 28/89 | 26/86 | 73 | 65 | 0.13 | 0.46 | 0.02 |
| Comp.Ex. 3 | 20/85 | 25/85 | 20/81 | 68 | 65 | 0.56 | 0.58 | 0.11 |
| Comp.Ex. 4 | 20/85 | 25/85 | 20/81 | 69 | 66 | 0.56 | 0.59 | 0.11 |

| | Root-mean-square average of roughness (μm) | | Smoothness (second) | | | |
|---|---|---|---|---|---|---|
| | Adhesive layer-contacted protective layer side ← | Adhesive layer-Contacted support side → | Adhesive layer-contacted protective layer side ← | Adhesive layer-contacted support side → | Quality of recorded image | Crack |
| Example 1 | 0.33 | 0.45 | $10 \times 10^3$ | $75 \times 10^2$ | 6 | None |
| Example 2 | 0.33 | 0.45 | $10 \times 10^3$ | $75 \times 10^2$ | 6 | None |
| Example 3 | 0.33 | 0.45 | $10 \times 10^3$ | $75 \times 10^2$ | 6 | None |
| Example 4 | 0.33 | 0.45 | $10 \times 10^3$ | $75 \times 10^2$ | 6 | None |
| Example 5 | 0.33 | 0.45 | $10 \times 10^3$ | $75 \times 10^2$ | 6 | None |
| Example 6 | 0.33 | 0.45 | $10 \times 10^3$ | $75 \times 10^2$ | 4 | None |
| Example 7 | 0.33 | 0.45 | $10 \times 10^3$ | $75 \times 10^2$ | 5 | None |
| Example 8 | 0.42 | 0.81 | $5 \times 10^3$ | $4 \times 10^2$ | 3 | None |
| Example 9 | 0.63 | 0.81 | $1 \times 10^3$ | $4 \times 10^2$ | 3 | None |
| Example 10 | — | 0.45 | — | $75 \times 10^2$ | 3 | None |
| Example 11 | — | 0.45 | — | $75 \times 10^2$ | 3 | None |
| Example 12 | 0.33 | 0.45 | $10 \times 10^3$ | $75 \times 10^2$ | 3 | None |
| Example 13 | 0.63 | 0.45 | $10 \times 10^3$ | $75 \times 10^2$ | 3 | None |
| Example 14 | 0.38 | 0.81 | $5 \times 10^3$ | $4 \times 10^2$ | 5 | None |
| Example 15 | 0.42 | 0.45 | $10 \times 10^3$ | $75 \times 10^2$ | 3 | None |
| Comp.Ex. 1 | 0.85 | 0.45 | $10 \times 10^3$ | $75 \times 10^2$ | 2 | None |
| Comp.Ex. 2 | 0.31 | 0.45 | $10 \times 10^3$ | $75 \times 10^2$ | 1 | Cracked |
| Comp.Ex. 3 | 0.51 | 0.45 | $4 \times 10^3$ | $75 \times 10^2$ | 2 | None |
| Comp.Ex. 4 | 0.51 | 0.81 | $3 \times 10^3$ | $4 \times 10^2$ | 2 | None |

Table 2 shows the layer structure of the heat-sensitive recording material (including PET film) and mode of preparation. In Table 2, the abbreviations therein have the following meanings.

"PET" means a PET film (smooth-surfaced substrate).

"OC" means a protective layer comprising a water-soluble or water-dispersible resin.

"OC(EB)" means a protective layer formed by curing an electron beam-curable compound. This layer also acts as an adhesive layer.

"EB" means an adhesive layer formed by curing an electron beam-curable compound.

"ML" means an intermediate layer.

"TG" means a heat-sensitive recording layer.

"S" means a support.

"• •" means that the two layers are adhered by curing an electron beam-curable compound by irradiation with electron beam.

"←" shows the layer present in the protective layer side such as a protective layer or other layer which was contacted with the adhesive layer and with respect to which the root-mean-square average of roughness and Oken smoothness were measured before being contacted with the adhesive layer.

"43" shows the layer present in the support side such as a support or other layer which was contacted with the adhesive layer and with respect to which the root-mean-square average of roughness and Oken smoothness were measured.

In Examples 10 and 11, the protective layer was formed by curing an electron beam-curable compound and no adhesive layer was used. In other words, the protective layer also functions as adhesive layer. In Examples 10 and 11, such protective layer (=adhesive layer) was contacted with the PET film, and therefore the mark "←" was attached to the PET film.

In Table 2, (I) to (V) in the column of "Mode of preparation" correspond to the process (I) to (V) described in item "Process for producing a heat-sensitive recording material of the present invention".

TABLE 2

| | Layer structure | | Mode of preparation |
|---|---|---|---|
| Ex. 1 | PET/OC← | . . . EB/→ML/TG/S | (I) |
| Ex. 2 | PET/OC← | . . . EB/→ML/TG/S | (I) |
| Ex. 3 | PET/OC← | . . . EB/→ML/TG/S | (I) |
| Ex. 4 | PET/OC← | . . . EB/→ML/TG/S | (I) |
| Ex. 5 | PET/OC← | . . . EB/→ML/TG/S | (I) |
| Ex. 6 | PET/OC← | . . . EB/→ML/TG/S | (I) |
| Ex. 7 | PET/OC←/EB | . . . →ML/TG/S | (II) |
| Ex. 8 | PET/OC/TG/ML ← | . . . EB/→S | (III) |
| Ex. 9 | PET/OC/TG←/EB | . . . →S | (IV) |
| Ex. 10 | PET← | . . . OC(EB)/→ML/TG/S | (II) |
| Ex. 11 | PET←/OC(EB) | . . . →ML/TG/S | (v) |
| Ex. 12 | PET/OC← | . . . EB/→ML/TG/S | (I) |
| Ex. 13 | PET/OC← | . . . EB/→ML/TG/S | (I) |
| Ex. 14 | PET/OC/TG/ML←/EB | . . . →S | (IV) |
| Ex. 15 | PET/OC← | . . . EB/→ML/TG/S | (I) |
| Comp. Ex. 1 | PET/OC← | . . . EB/→ML/TG/S | (I) |
| Comp. Ex. 2 | PET/OC← | . . . EB/→ML/TG/S | (I) |
| Comp. Ex. 3 | PET/OC← | . . . EB/→ML/TG/S | (I) |
| Comp. Ex. 4 | PET/OC← | . . . EB/→ML/TG/S | (I) |

As clear from the results of Table 1, the heat-sensitive recording material of the present invention can produce a significant effect in respect of the quality of recorded image.

What is claimed is:

1. A heat-sensitive recording material which comprises (a) a support (S), (b2) a heat-sensitive recording layer (TG) containing an electron-donating compound and an electron-accepting compound and formed on at least one side of the support (S) and an adhesive layer (EB) comprising an electron beam-cured resin and formed on the heat-sensitive recording layer (TG), or (b3) an adhesive layer (EB) comprising an electron beam-cured resin and formed on at least one side of the support (S) and a heat-sensitive recording layer (TG) containing an electron-donating compound and an electron-accepting compound and formed on the adhesive layer (EB); and (c) a protective layer (OC) comprising a water-soluble resin and/or a water-dispersible resin, and optionally, (d) an intermediate layer (ML) comprising a water-soluble resin and/or a water-dispersible resin and formed between the heat-sensitive recording layer (TG) and the adhesive layer (EB), the protective layer (OC) being the outermost layer provided by being formed on a smooth-surfaced substrate and removing the smooth-surfaced substrate, the smooth-surfaced substrate being 0.05 to 0.20 $\mu$m in root-mean-square average of roughness (JIS B0601-1982) as determined by an interference microscope (JIS B0652-1973), the protective layer surface having a distinctness of image (according to JIS K 7105-1981) of at least 75% (slit width 2 mm), and the adhesive layer containing a pigment having an average particle size of 0.2 to 3 $\mu$m.

2. The heat-sensitive recording material according to claim 1, wherein the recorded portion formed by carrying out recording from the protective layer side with an energy of 80 mJ/mm$^2$ by a thermal head shows a distinctness of image (according to JIS K 7105-1981) of at least 75% (slit width 2 mm).

3. The heat-sensitive recording material according to claim 1, wherein the recorded portion formed by carrying out recording from the protective layer side with an energy of 80 mJ/mm$^2$ by a thermal head is 0.15 to 0.50 $\mu$m in root-mean-square average of roughness (according to JIS B0601-1982) as determined by an interference microscope (JIS B0652-1973).

4. The heat-sensitive recording material according to claim 1, wherein the recorded portion formed by carrying out recording from the protective layer side with an energy of 80 mJ/mm$^2$ by a thermal head exhibits a gloss (JIS P 8142-1993) of 30% or more at 20 degrees and 85% or more at 75 degrees.

5. The heat-sensitive recording material according to claim 1 which comprises:

(a) the support (S), (b) the heat-sensitive recording layer (TG) formed on one side of the support (S), the intermediate layer (ML) formed on the heat-sensitive recording layer and the adhesive layer (EB) formed on the intermediate layer, and (c) the protective layer (OC) formed on the adhesive layer (EB).

6. The heat-sensitive recording material according to claim 1, wherein the adhesive layer is provided by forming an uncured adhesive layer containing an electron beam-curable compound and curing the electron beam-curable compound by irradiation with electron beam.

7. The heat-sensitive recording material according to claim 6, wherein the electron beam-curable compound is a hydroxyl group-containing electron beam-curable compound.

8. The heat-sensitive recording material according to claim 7, wherein the hydroxy group-containing electron beam-curable compound is 2-hydroxyethyl (meth)acrylate, 2-hydroxypropyl (meth)acrylate, 2-hydroxy-3-phenoxypropyl acrylate or (meth)acrylic acid condensate of epichlorohydrin-alkanediol polymer.

9. The heat-sensitive recording material according to claim 1 which comprises:

the support (S), the adhesive layer (EB) formed on the support, the heat-sensitive recording layer (TG) formed on the adhesive layer (EB), and the protective layer (OC) formed on the heat-sensitive recording layer (TG).

10. The heat-sensitive recording material according to claim 1 which comprises:

the support (S), the adhesive layer (EB) formed on the support, the intermediate layer (ML) formed on the adhesive layer, the heat-sensitive recording layer (TG) formed on the intermediate layer, and the protective layer (OC) formed on the heat-sensitive recording layer.

11. A process for producing a heat-sensitive recording material which comprises:

(a) a support (S), (b2) a heat-sensitive recording layer (TG) containing an electron-donating compound and an electron-accepting compound formed on at least one side of the support (S)

and an adhesive layer (EB) comprising an electron beam-cured resin and formed on the heat-sensitive recording layer (TG), (c) a protective layer (OC) comprising a water-soluble resin and/or a water dispersible resin, and (d) an intermediate layer (ML) comprising a water-soluble resin and/or a water-dispersible resin and formed between the heat-sensitive recording layer (TG) and the adhesive layer (EB), the protective layer surface having a distinctness of image of at least 75% (according to JIS K 7105-1981, silt width 2 mm), and the adhesive layer containing a pigment having an average particle size of 0.2 to 3 μm, the process comprising:

forming the protective layer on a smooth-surfaced substrate with a smooth surface which is about 0.05 to about 0.20 μm in root-mean-square average of roughness (according to JIS B0601-1982) as determined by an interference microscope (according to JIS B0652-1973), combining the protective layer (OC) formed on the smooth-surfaced substrate with a laminate comprising the support (S), the heat-sensitive recording layer (TG), the intermediate layer (ML) and an uncured adhesive layer comprising an electron beam-curable compound and the pigment having an average particle size of 0.2 to 3 μm in this order, in such a manner that the protective layer (OC) is brought into contact with the uncured adhesive layer, irradiating the combined product with an electron beam to cure the electron beam-curable compound and form the adhesive layer (EB) comprising an electron beam-cured resin, and removing the smooth-surfaced substrate.

12. The process according to claim 11, wherein the adhesive layer contains said pigment having an average particle size of 0.2 to 3 μm in an amount of 2 to 30% by weight based on the adhesive layer.

13. The process according to claim 11, wherein the electron beam-curable compound is a hydroxyl group-containing electron beam-curable compound.

14. The process according to claim 13, wherein the hydroxyl group-containing electron beam-curable compound is 2-hydroxyethyl (meth)acrylate, 2-hydroxypropyl (meth)acrylate, 2-hydroxy-3-phenoxypropyl acrylate or (meth)acrylic acid condensate of epichlorohydrin-alkanediol polymer.

15. A process for producing a heat-sensitive recording material which comprises:

(a) a support (S), (b3) an adhesive layer (EB) comprising an electron beam-cured resin and formed on at least one side of the support (S) and a heat-sensitive recording layer (TG) containing an electron-donating compound and an electron-accepting compound and formed on the adhesive layer (EB);

(c) a protective layer (OC) comprising a water-soluble resin and/or a water dispersible resin and formed on the heat-sensitive recording layer (TG), and (d) an intermediate layer (ML) comprising a water-soluble resin and/or a water-dispersible resin and formed between the heat-sensitive recording layer (TG) and the adhesive layer (EB), the protective layer surface having a distinctness of image of at least 75% (according to JIS K 7105-1981, slit width 2 mm), and the adhesive layer containing a pigment having an average particle size of 0.2 to 3 μm, the process comprising:

forming the protective layer on a smooth-surfaced substrate with a smooth surface which is about 0.05 to about 0.20 μm in root-mean-square average of roughness (according to JIS B0601-1982) as determined by an interference microscope (according to JIS B0652-1973), combining the protective layer (OC) formed on the smooth-surfaced substrate and the heat-sensitive recording layer (TG) formed on the protective layer and the intermediate layer (ML) formed on the heat-sensitive recording layer with a laminate comprising the support (S) and an uncured adhesive layer comprising an electron beam-curable compound and the pigment having an average particle size of 0.2 to 3 μm in this order, in such a manner that the intermediate layer (ML) is brought into contact with the uncured adhesive layer, irradiating the combined product with an electron beam to cure the electron beam-curable compound and form the adhesive layer (EB) comprising an electron beam-cured resin, and removing the smooth-surfaced substrate.

16. The process according to claim 15, wherein the adhesive layer contains said pigment having an average particle size of 0.2 to 3 μm in an amount of 2 to 30% by weight based on the adhesive layer.

17. The process according to claim 15, wherein the electron beam-curable compound is a hydroxyl group-containing electron beam-curable compound.

18. The process according to claim 17, wherein the hydroxyl group-containing electron beam-curable compound is 2-hydroxyethyl (meth)acrylate, 2-hydroxypropyl (meth)acrylate, 2-hydroxy-3-phenoxypropyl acrylate or (meth)acrylic acid condensate of epichlorohydrin-alkanediol polymer.

19. A process for producing a heat-sensitive recording material which comprises:

(a) a support (S), (b3) an adhesive layer (EB) comprising an electron beam-cured resin and formed on at least one side of the support (S) and a heat-sensitive recording layer (TG) containing an electron-donating compound and an electron-accepting compound and formed on the adhesive layer (EB); and (c) a protective layer (OC) comprising a water-soluble resin and/or a water dispersible resin, the protective layer surface having a distinctness of image of at least 75% (according to JIS K 7105-1981, slit width 2 mm), and the adhesive layer containing a pigment having an average particle size of 0.2 to 3 μm, the process comprising:

forming the protective layer on a smooth-surfaced substrate with a smooth surface which is about 0.05 to about 0.20 μm in root-mean-square average of roughness (according to JIS B0601-1982) as determined by an interference microscope (according to JIS B0652-1973), combining the support (S) with a laminate comprising the smooth-surfaced substrate, the protective layer (OC), the heat-sensitive recording layer (TG), and an uncured adhesive layer comprising an electron beam-curable compound in this order, in such a manner that the uncured adhesive layer is brought into contact with the support (S), irradiating the combined product with an electron beam to cure the electron beam-curable compound, and removing the smooth-surfaced substrate.

20. The process according to claim 19, wherein the adhesive layer contains said pigment having an average particle size of 0.2 to 3 $\mu$m in an amount of 2 to 30% by weight based on the adhesive layer.

21. The process according to claim 19, wherein the electron beam-curable compound is a hydroxyl group-containing electron beam-curable compound.

22. The process according to claim 21, wherein the hydroxyl group-containing electron beam-curable compound is 2-hydroxyethyl (meth)acrylate, 2-hydroxypropyl (meth)acrylate, 2-hydroxy-3-phenoxypropyl acrylate or (meth)acrylic acid condensate of epichlorohydrin-alkanediol polymer.

* * * * *